US008806806B2

(12) United States Patent
Leivenzon et al.

(10) Patent No.: US 8,806,806 B2
(45) Date of Patent: Aug. 19, 2014

(54) ELECTRONICALLY POWERED DOOR WITH A MANUAL OVERRIDE MECHANISM

(75) Inventors: Jack Leivenzon, Blackburn (AU); Glen Edward Flemming, Berwick (AU); Eric Vellere, Kalkallo (AU)

(73) Assignee: Smart Openers Pty Ltd, Blackburn, Victoria (AU)

( * ) Notice: Subject to any disclaimer, the term of this patent is extended or adjusted under 35 U.S.C. 154(b) by 229 days.

(21) Appl. No.: 13/387,365

(22) PCT Filed: Jul. 27, 2010

(86) PCT No.: PCT/AU2010/000944

§ 371 (c)(1),
(2), (4) Date: Jun. 1, 2012

(87) PCT Pub. No.: WO2011/011816

PCT Pub. Date: Feb. 3, 2011

(65) Prior Publication Data

US 2012/0240470 A1 Sep. 27, 2012

(30) Foreign Application Priority Data

Jul. 30, 2009 (AU) ..... 2009903556

(51) Int. Cl.
*E05F 15/00* (2006.01)

(52) U.S. Cl.
USPC ..... 49/140; 49/139; 49/199; 49/200; 160/310; 192/71; 192/93 R; 192/107 T

(58) Field of Classification Search
USPC ..... 49/199, 197, 200, 139, 140; 74/625, 74/490.11; 160/188, 133, 310, 321; 192/71, 93 R, 107 T
See application file for complete search history.

(56) References Cited

U.S. PATENT DOCUMENTS

| | | | | | |
|---|---|---|---|---|---|
| 2,718,294 | A * | 9/1955 | Armstrong | 192/105 BA |
| 3,367,465 | A * | 2/1968 | Newman | 192/105 BA |
| 3,527,327 | A * | 9/1970 | Mccreary | 192/46 |
| 4,445,604 | A * | 5/1984 | Rogers, Jr. | 192/71 |
| 5,090,532 | A * | 2/1992 | Bich | 464/37 |
| 5,105,131 | A * | 4/1992 | Schap | 318/282 |
| 5,362,293 | A * | 11/1994 | Romanauskas | 494/84 |
| 5,839,555 | A * | 11/1998 | Hsieh | 192/223.1 |
| 6,712,116 | B2 * | 3/2004 | Beaudoin et al. | 160/188 |
| 2002/0079182 | A1 * | 6/2002 | Kettler | 192/43.2 |
| 2005/0022453 | A1 | 2/2005 | Bosio | 49/343 |
| 2005/0172559 | A1 * | 8/2005 | Hsieh | 49/140 |
| 2008/0271859 | A1 * | 11/2008 | Kourtesis et al. | 160/310 |

FOREIGN PATENT DOCUMENTS

WO 88/04716 6/1988

OTHER PUBLICATIONS

International Search Report for PCT/AU2010/000944 issued on Oct. 7, 2010.

* cited by examiner

*Primary Examiner* — Katherine Mitchell
*Assistant Examiner* — Marcus Menezes
(74) *Attorney, Agent, or Firm* — Ladas & Parry, LLP

(57) ABSTRACT

Embodiments of the resent invention provide an electric motor driven door or barrier opener with a manually operable drive for use in the event of a power failure. The operator includes a manually rotatable drive wheel and manual rotation of the drive wheel effects a movement of at least one drive coupler in generally radially extending direction relative to the drive shaft to effect a drive coupling between the drive wheel and the drive shaft to input drive to permit manual opening and or closing of the door.

8 Claims, 17 Drawing Sheets

ELECTRONICALLY POWERED DOOR WITH A MANUAL OVERRIDE MECHANISM

CROSS-REFERENCE TO RELATED APPLICATIONS

This application is the U.S. National Stage of International Patent Application No. PCT/AU2010/000944 filed on Jul. 27, 2010, which claims priority to Australian Patent Application No. 2009903556 filed on Jul. 30, 2009, the disclosures of which are hereby incorporated by reference in their entireties.

FIELD OF THE INVENTION

This invention relates to the manual operation of a door operator to open and close a door driven by the operator in the event of a power failure.

BACKGROUND OF THE INVENTION

Typically, doors or barriers such as garage doors and industrial doors are driven to the open and closed positions by a door operator device that uses an electric motor. If the power should fail, then the door may need to be opened and/or closed manually.

Typically but not exclusively, the doors are roller doors and the door curtain is wound onto or off a curtain drum mounted above the doorway. Thus, the door operator, including the electric motor, is mounted above the doorway to drive connect with the curtain. For a person to manually reach the door operator to effect local manual operation at the operator is difficult due to the elevated position of the operator. This problem is exacerbated with industrial doors as the operator is typically some three meters or more off the floor.

It has been known to provide the operator with a drive wheel which can be manually rotated in the event of power failure to permit manual opening and closing of the door. The drive wheel is typically manually rotated by a person pulling an endless chain that extends over the drive wheel. A clutch mechanism is provided to release drive connection with the drive wheel and the door during normal motor driven operation of the operator. The clutch therefore prevents unwanted rotation of the drive wheel during normal operation of the motor, which in turn, prevents the endless chain from otherwise moving uncontrollably and becoming entangled with any building structure or with personnel. Thus, if the power should fail, the clutch needs to be engaged to permit a drive connection with the drive wheel. Numerous clutch systems have been devised but each has its own attendant disadvantages. A common problem with the clutch mechanisms is to ensure safety of operation at all times. For example, if the clutch should accidentally engage during normal motor driven operation of the motor, the drive wheel will be rotated which, in turn, will cause the endless chain to move uncontrollably and this has the aforementioned safety issue with regard adjacent structures and/or personnel. Some clutch mechanisms require the manual operation of a clutch arm to effect drive engagement or disengagement with the manually operable drive wheel. This usually requires a further user reachable chain or a cord to connect with the clutch operator mechanism. In some cases, the drive wheel is provided with an automatic mechanism to effect clutch drive engagement once the drive wheel is initially rotated. Such clutch mechanisms operate by causing a lateral movement along the longitudinal central axis of the drive wheel to displace a clutch and/or the drive wheel in a direction along the longitudinal axis of the drive wheel. Such clutch mechanisms have not always been reliable.

There is a need for improved clutch mechanism associated with a door operator device of this type.

SUMMARY OF THE INVENTION

Therefore, according to a first broad aspect of the present invention there is provided an electric motor driven door or barrier opener with a manually operable drive for use in the event of a power failure, said operator comprising a gear box drive connectable with an electric motor of said operator, said gear box comprising an output for drive coupling with said door to effect opening and closing of said door by said motor, said gear box also comprising a shaft that drive rotates when said motor rotates, said shaft carrying a free wheeling manually rotatable drive wheel as said manually operable drive and useable in the event of power failure to effect manual drive rotation movement of said shaft to open and close the door via said gearbox, said manually rotatable drive wheel comprising at least one drive coupler mounted to move in a generally radially extending direction relative to a central longitudinal axis of said shaft so that when the manual rotatable drive wheel is not manually rotated there will be no drive coupling connection between said drive wheel and said shaft and said drive wheel can free wheel, and when there is a manual rotation of said drive wheel in the event of a power failure the manual rotation will effect a movement of said at least one drive coupler in the generally radially extending direction to effect a drive coupling between said drive wheel and said shaft so continued rotation of said drive wheel will input drive to said shaft to permit manual opening and or closing of said door via said gear box.

In one embodiment, said at least one drive coupler is biased by biasing means to assume a position displaced in a generally radially extending direction relative to the central longitudinal axis of said shaft so that said drive wheel can free wheel relative to said shaft under motor driven rotation of the drive of said gear box.

BRIEF DESCRIPTION OF THE DRAWINGS

In order that the invention can be more clearly ascertained, an example of an embodiment for use with an industrial roller door will now be described wherein:

FIG. 9 shows a drive engaged condition.

DETAILED DESCRIPTION

Figure 1:
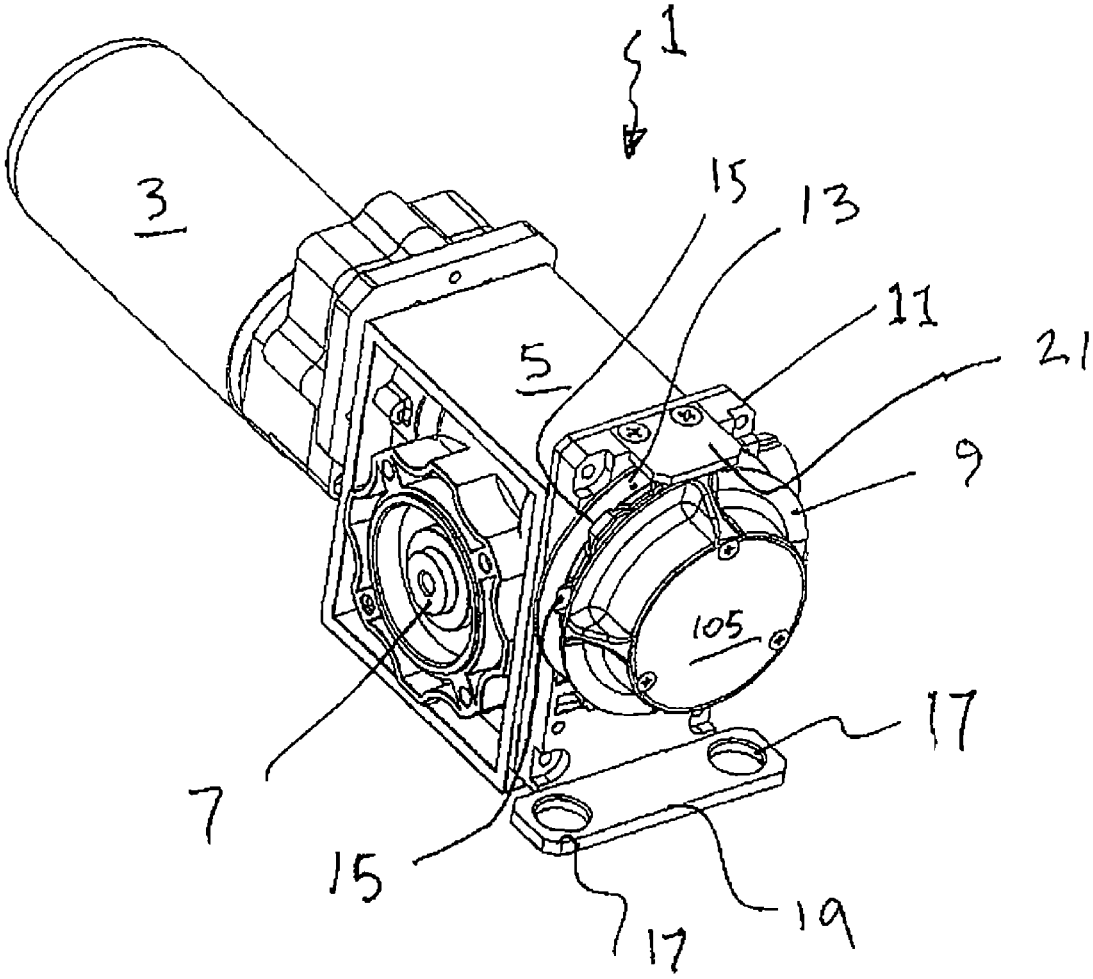
FIG. 1 is a top isometric view of a door operator incorporating a manually rotatable drive wheel.
Figure 2:
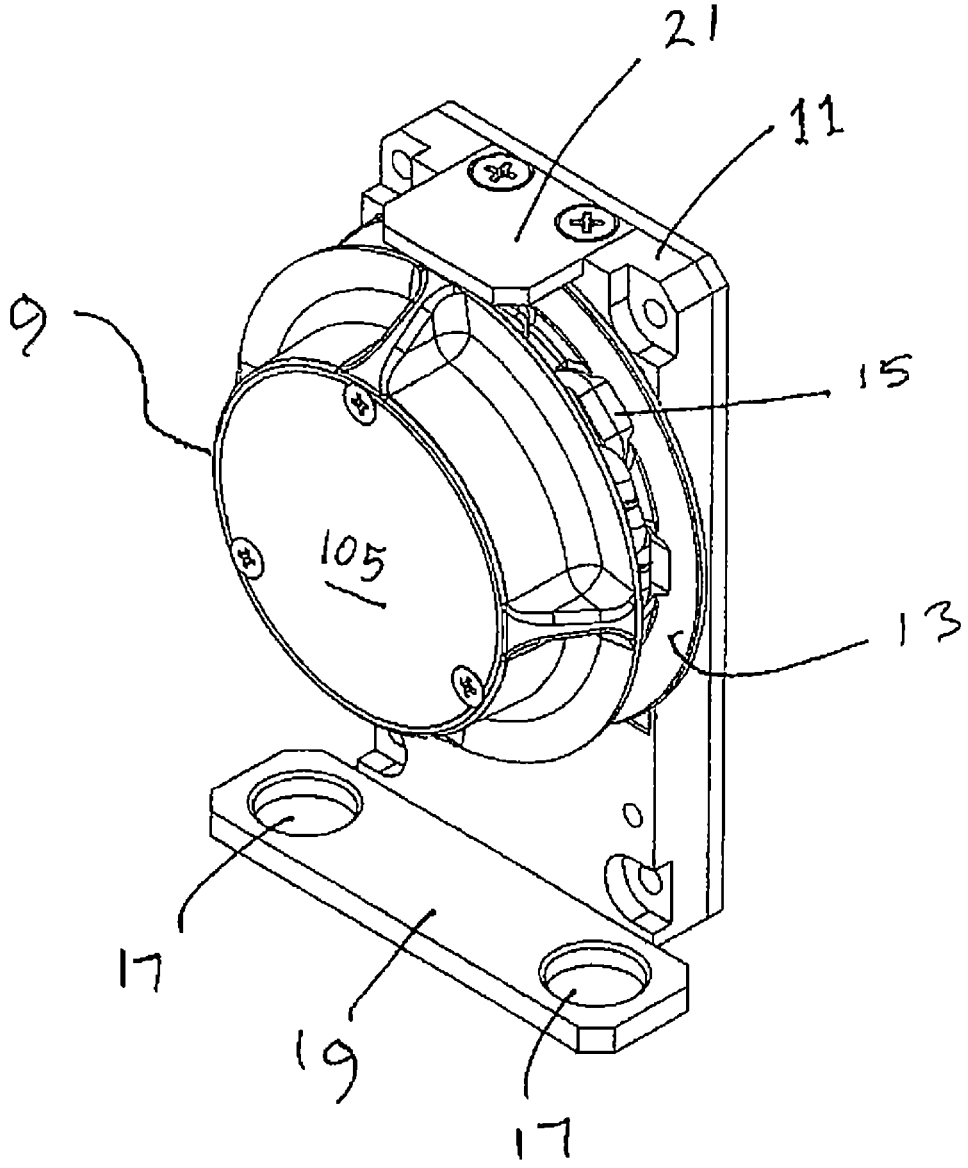
FIG. 2 is a an isometric view of the manually rotatable drive wheel shown in FIG. 1 at a different viewing orientation.

Referring firstly to FIG. 1, there is shown a door or barrier operator 1 that comprises an electric motor 3 and a gearbox 5. The electric motor 3 can be either an A.C. motor or a D.C. motor. In this example, the electric motor 3 is a D.C. motor. The motor 3 can be reversed in its direction of rotation to cause the door (not shown) to be open and closed. Typically, the door or barrier comprises a roller door which is wound onto or off a roller drum provided at the top of a doorway. The gearbox 5 has an output 7 for coupling the door to the operator to effect opening and closing of the door by the motor 3. The gearbox 5 is typically a reduction gearbox so that the output 7 will rotate relatively slowly compared to the output speed of rotation from the motor 3 and so there will be a required power delivered at the output 7 to effect the opening and closing of the door. Typically, the central rotational axis of output 7 is axially aligned with the longitudinal central axis of the curtain drum, and appropriate drive connection is made to wind the door curtain onto or off the drum to open and close the door consequent on rotation of the output 7.

A manually operable drive wheel 9 is rotatably mounted on a chassis plate 11 that is, in turn, mounted to the gear box 5. The gearbox 5 has a shaft 25 (not shown in FIG. 1) that rotates when the motor 3 rotates. The manually rotatable drive wheel 9 is carried on the shaft 25 so that it can freewheel relative to the shaft 25 under normal operation of the operator via the motor 3. The details of the shaft 25 and the arrangement will be described in due course. The drive wheel 9 is formed with a chain groove 13 to permit a chain (not shown) to be looped over the chain groove 13 to permit the chain to be pulled either from a left side or a right side to effect manual rotation of the drive wheel 9. Teeth 15 are provided in the chain groove to locate within link openings in the chain so that force can be applied via the chain to rotate the drive wheel 9. The chain is an endless chain that is looped over the drive wheel 9 and passed through chain guide openings 17 carried on a bracket 19 that extends from the bottom of the chassis plate 11. A chain keeper 21 extends from the top of the chassis plate 11 and holds the chain engaged with the teeth 15.

Accordingly, when there is drive engagement of the drive wheel 9 with the shaft 25 (not shown in FIG. 1) there can be rotation of the shaft 25 and a corresponding operation of the gear box 5 to effect manual rotation of the output 7. Motor 3 may rotate during manual operation of the drive wheel 9 in the absence of power supplied to the motor 3. Accordingly, in the event of power failure, the drive wheel 9 can be engaged to drive the gearbox 5 to, in turn, effect rotation of the output 7 to open and close the door. The direction of rotation will be dependent on the direction of pulling of the chain from either the left or the right hand side of the drive wheel 9.

Figure 3:
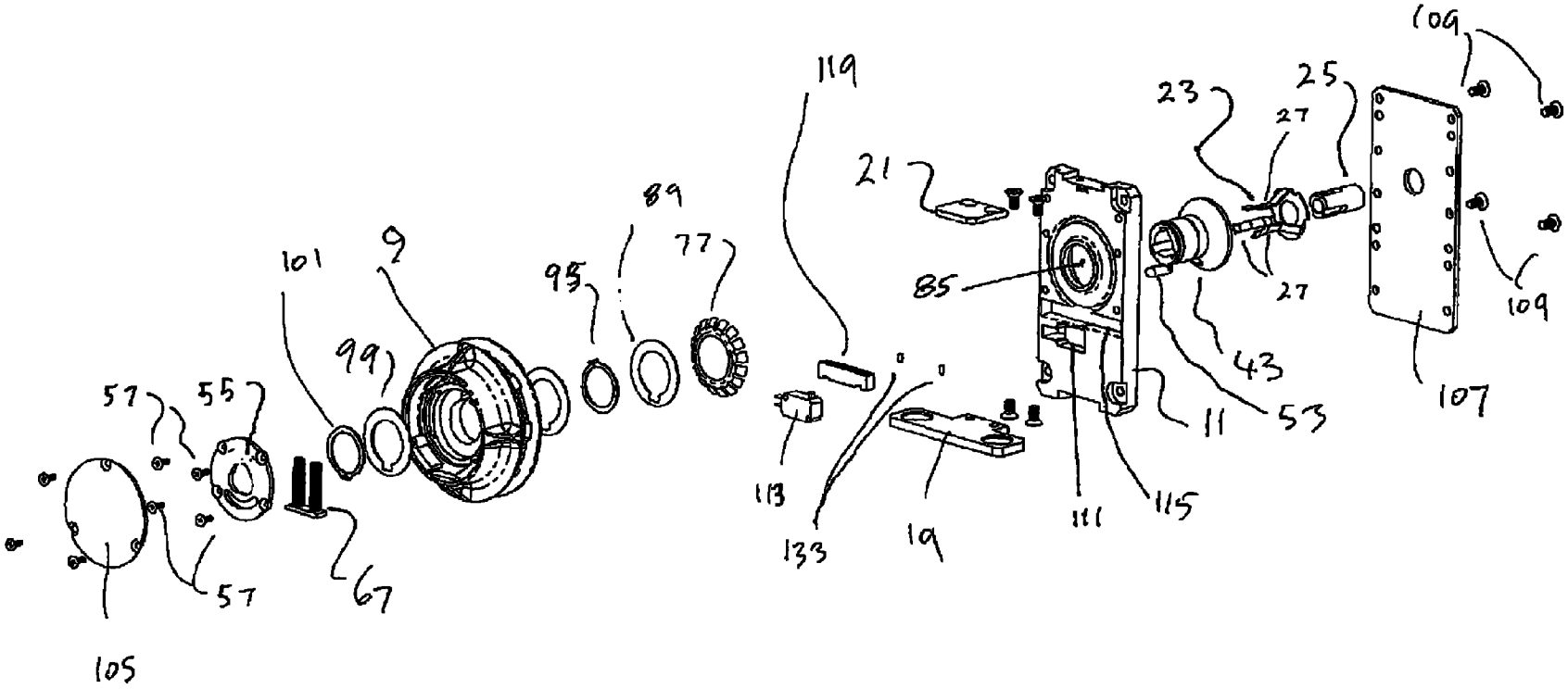
FIG. 3 is an exploded isometric view of the components of the manually rotatable drive wheel shown in the preceding figures.

Referring now to FIG. 3 there is shown an exploded isometric view of the components associated with the manually rotatable drive wheel 9 and the chassis plate 11. Here, the chassis plate 11 is shown having a number of structural features to accommodate the various components associated with effecting a clutch type drive engagement and drive releasing function. Reference will need to be made to FIGS. 4-20 for a detailed description of the components, and it will be necessary to return to FIG. 3 to understand the physical positioning of the components relative to one another.

Figure 19:
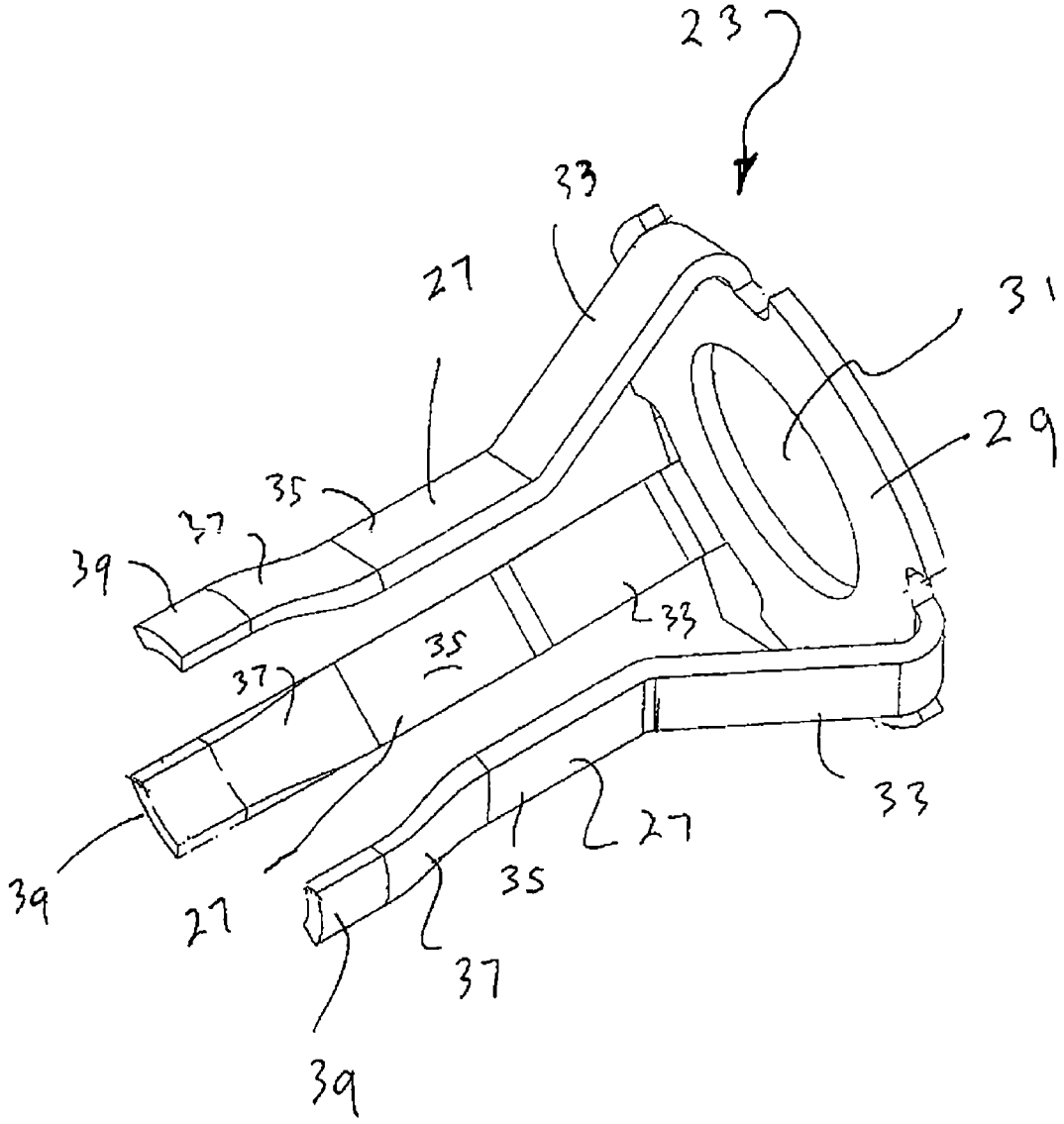
FIG. 19 is a perspective view of a drive coupler.

A drive coupler 23 is provided and mounted on shaft 25 (previously referred to but not shown in FIG. 1) that extends from the gearbox 5 and drive rotates when the motor 3 rotates. The drive coupler 23 has three fingers 27 extending from a central disc like body 29. In this embodiment, three fingers are provided, however, any number of fingers may be provided. The fingers 27 are equally angularly spaced around the circumference of the body 29. The body 29 has a central aperture 31 so that the drive coupler 23 can be fitted over the shaft 25. The fingers 23 therefore are shaped to extend longitudinally along the longitudinal central axis of the shaft 25. The drive coupler 23 is made from a quality spring steel material or similar material that exhibits spring like characteristics. It can be seen from FIG. 19 that the fingers 23 have a radially inwardly directed portion 33, a central portion 35 that extends substantially parallel with the longitudinal central axis of the shaft 25, and a flared outwardly directed portion 37 that terminates with end cam contact surfaces 39. The fingers 27 are biased to an outwardly displaced position as shown in FIG. 19 so that the central portions 35 will normally assume a radially displaced position from the central longitudinal axis of shaft 25 and not engage with the external surface of shaft 25.

Figure 8:
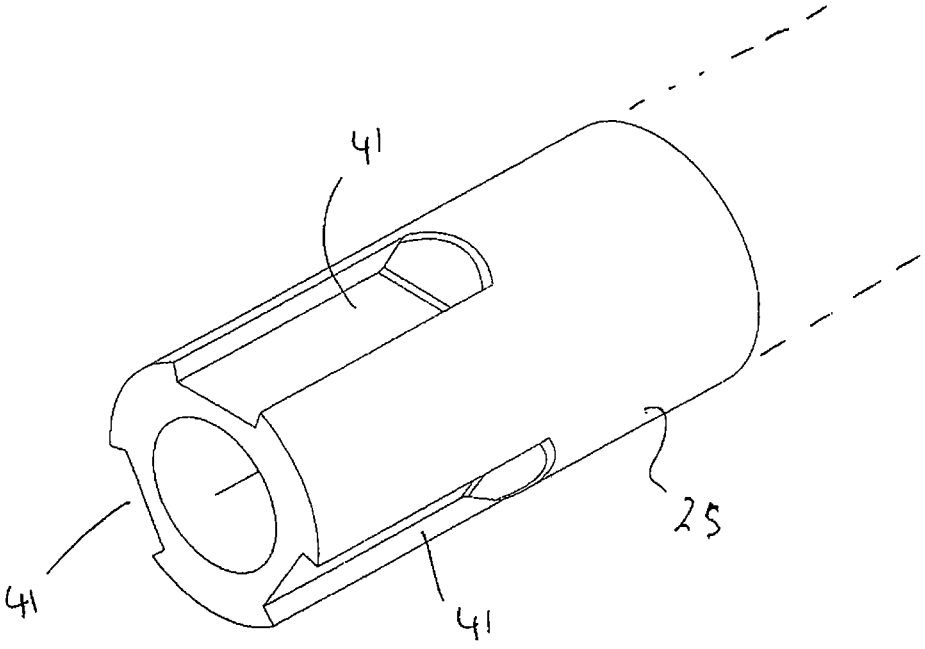
FIG. 8 is an isometric view of an end of a shaft that is drive rotatable from a gearbox that forms part the operator shown in FIG. 1.

Shaft 25 is shown in FIG. 8. FIG. 8 shows the shaft 25, and the dotted line portion indicates the portion which is within the housing of the gearbox 5. The solid line portion shown in FIG. 8 represents the portion of the shaft 25 that extends or protrudes outwardly from the casing of the gearbox 5. FIG. 8 shows that the shaft 25 has longitudinally extending slots 41 machined into the outer surface thereof. The slots 41 are equally angularly spaced around the circumference of the shaft 25 and correspond with the angular arrangement of the fingers 27 on the drive coupler 23. The length of the slots 41 is at least equal to the length of the central portions 35 of the end fingers 27. Accordingly, the drive coupler 23 is mounted so that the fingers 27 can displace in a generally radially extending direction relative to the central longitudinal axis of the shaft 25. This occurs by reason of flexing of the fingers 27 and by the bias imparted thereto by nature of the spring steel material or similar material from which the drive coupler 23 is made.

Figure 9:
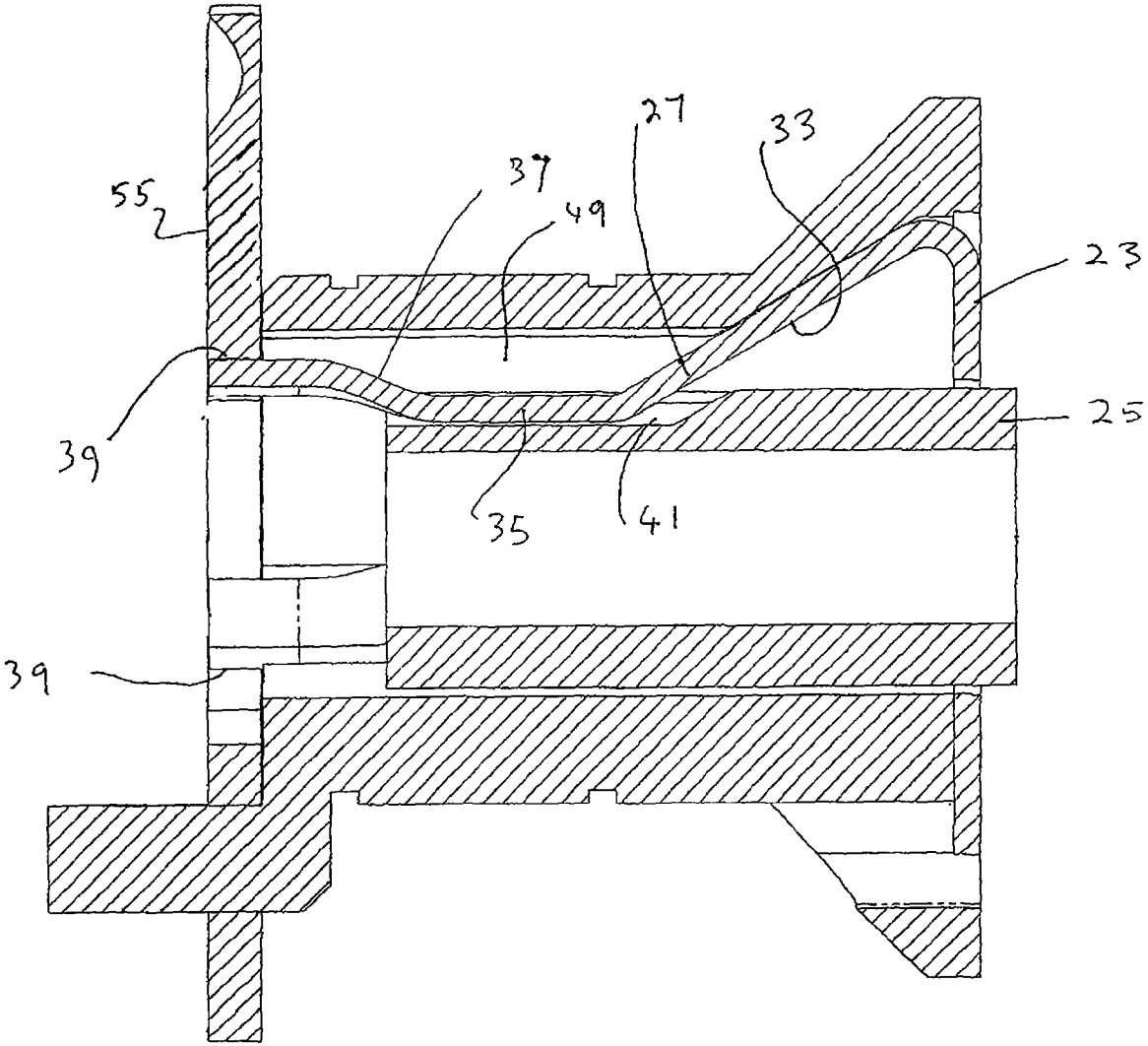
FIG. 9 is a vertical cross sectional view taken through some of the drive components that permit drive between the gearbox and the manually rotatable drive wheel.

FIG. 9 shows the arrangement of mounting of the drive coupler 23 over the shaft 25 and how the fingers 27 locate about the shaft 25. FIG. 9 also shows the arrangement where the fingers 27 have been displaced inwardly so that the central portions 35 engage into the slots 41 and permit rotatable drive connection to the shaft 25. The way in which the fingers 27 are displaced will be described in due course.

Figure 20:
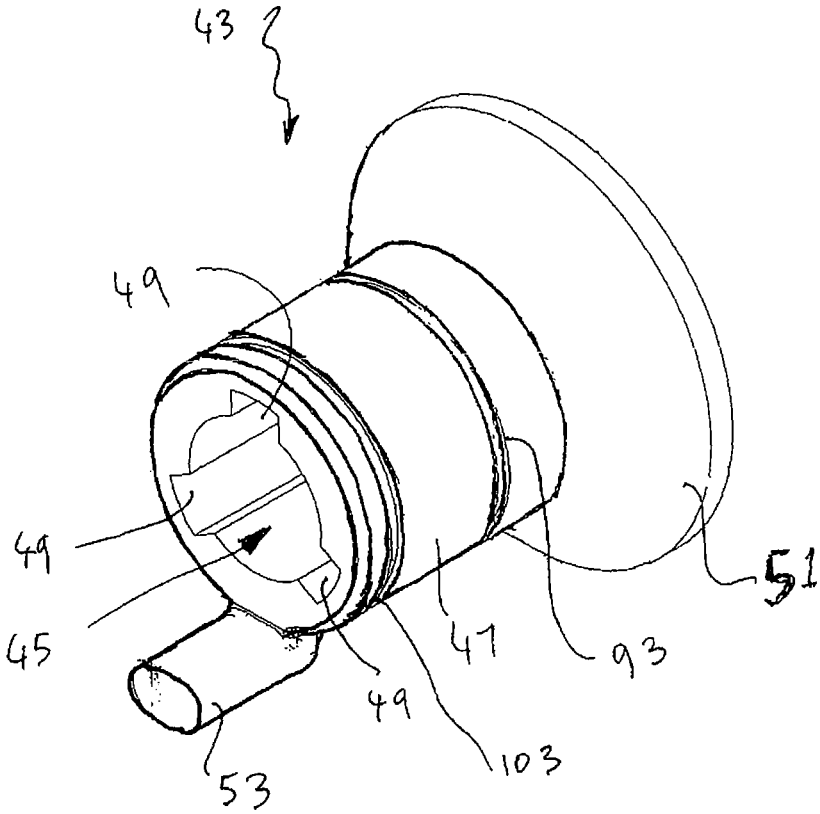
FIG. 20 is a perspective view of a drive coupler keeper and cam activating member.

FIG. 20 shows an end isometric view of a drive coupler keeper and cam activating member 43. The drive coupler and cam activating member 43 is made from an industrial quality plastics material or from a die casting metal or similar. It has a central bore 45 within a central sleeve like body 47. The bore 45 is of a size to enable the shaft 25 to be received therein so that the drive coupler and cam activating member 43 can rotate relative to the shaft 25. The bore 45 has longitudinally and radially outwardly extending slots 49 that are equally angularly spaced around the circumference and of a size to enable the fingers 27 to be received therein when they are moved radially outwardly by the spring bias applied by the drive coupler 23. The drive coupler and cam activating member 43 has a conical shaped head 51 at one end, and protruding tongue 53 at the opposite end. The tongue 53 can be moulded integrally with the drive coupler and cam activating member 43, or it may be made separately and suitably attached thereto.

A disc cam plate 55 (see FIG. 5) is provided and fixedly fastened to the manually rotatable drive wheel 9 by attachment means 57 (see FIG. 3). The cam plate 55 has an arcuate slot (see FIG. 5) into which the tongue 53 is received when all the components are assembled. The cam plate 55 can be made from a suitable material such as a metal. A centre of the cam plate 55 contains a central aperture 61 that defines three cam lobes that are radially innermost, and that also defines three outermost reliefs 65. The lobes 63 and the reliefs 65 are equally angularly spaced around the circumference of the aperture 61.

When all the components are assembled, rotation of the manually rotatable drive wheel 9 causes the cam plate 55 to be angularly rotated therewith. This, in turn, allows rotation of the cam plate 55 to a clockwise or anticlockwise rotated position where a respective end of the arcuate slot 59 engages with the tongue 53. The cam lobes 63 are therefore angularly rotated and operate on the cam contact surfaces 39 of the drive coupler 23 to radially move the fingers 27 inwardly so the central portions 35 withdraw radially inwardly from the slots 49 and flex inwardly into the slots 41 in the shaft 25. Continued rotation of the manually rotatable drive wheel 9 then imparts drive through the cam plate 55 and the drive coupler 23 to rotate the shaft 25.

In this way, a manual operation of the gearbox can be effected by rotation of the manually rotatable drive wheel 9. This allows the door to be opened and/or closed in the event of a power failure.

When there is no manual drive applied to the manually rotatable drive wheel 9, the cam plate 55 is moved to a position under the influence of a centralising biasing means 67 as will be described in due course. In this centralising position when no manual rotation is applied to the drive wheel 9, the lobes 63 assume an angular oriented position to enable the cam contact surfaces 39 on the drive coupler 23 to move into the relief 65, thereby allowing fingers 27 to radially move outwardly and into the slots 49 in the drive coupler and cam activating member 49, and release drive connection between the drive wheel 9 and the shaft 25.

Figure 4:
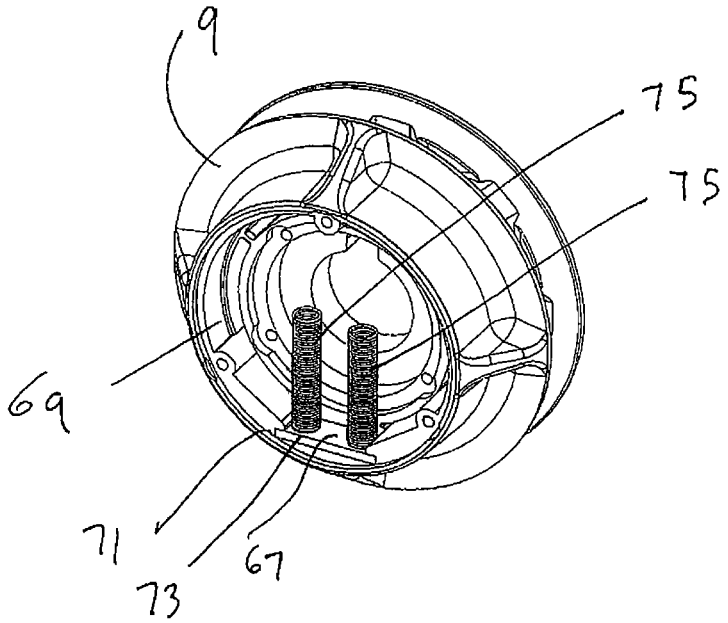
FIG. 4 is an end isometric view of the drive wheel (with a cover plate removed to aid clarity of viewing)
Figure 5:
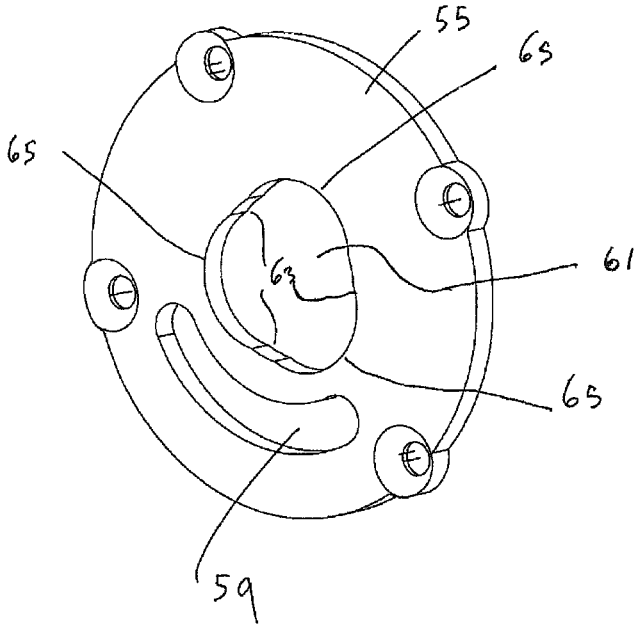
FIG. 5 is an isometric view of a cam plate that is connected directly with the manually rotatable drive wheel.

FIG. 4 shows the arrangement of the centralising biasing means 67. The drive wheel 9 has a hollow central body part 69 that defines a socket 71 into a which a base plate 73 can be can be slidably received and retained. The base plate 73 is typically made of metal such as suitable corrosion coated steel. Two resilient fingers 75 extend inwardly to the central rotational axis of drive wheel 9 in spaced apart relationship from the base plate 73. Typically, the base plate 73 may have upstanding pins onto which hollow tubular coil spring fingers that form the centralising biasing means 67 can be received. In one example, the resilient fingers 75 may be of spring steel but other embodiments may be made of a suitable resilient material such as plastics. The fingers 75 are spaced apart sufficiently to allow the tongue 53 of the drive coupler and cam activating member 43 to be received therebetween in a close fitting arrangement. In operation, as the drive wheel 9 is rotated, the cam plate 55 is rotated and bias forces are applied from a respective one of the resilient fingers 75 to the side faces of the tongue 53 as the finger defects sideways. When the tongue 53 engages with the end of the arcuate slot 59, one of the resilient fingers 75 will then be flexed sideways and will apply a bias force in a direction to return the finger 53 towards a centralised position between the two ends of the arcuate slot 59. Accordingly, when drive forces are released from the drive wheel 9, there will be relative rotation of the drive wheel 9 together with the cam plate 55 caused by that bias so that the tongue 53 will assume a generally central position between the ends of the arcuate slot 59. This, in turn, will release the cam lobes 63 from forcing the fingers 27 of the drive coupler 23 into the slots 41 in the drive shaft 25. Thus, there will be drive disconnection between the drive wheel 9 and the shaft 25.

When the fingers 27 are radially outermost and not within the slots 41 of the drive shaft 25, then when the motor 3 drives the gearbox and causes rotation of the shaft 25, the manually rotatable drive wheel 9 can freewheel relative to the shaft 25.

FIG. 3 shows there is provided a diaphragm spring 77 within the assembly. The diaphragm spring 77 is shown in detail in FIG. 14. Here, the spring has a central annular body 79 with a plurality of radially outwardly inclined fingers 81. The diaphragm spring 77 can be made from suitable spring steel or from a suitable plastics material or other suitable material. The diaphragm spring 77 is provided to preload a force to draw the conical head 51 of the drive coupler and cam activating member 43 into contact with a corresponding conical face 83 in a rear surface of the chassis plate 11. The conical surface 83 is shown in detail in FIG. 7. In this arrangement, the sleeve body 47 of the drive coupler and cam activating member 43 passes through a central opening 85 in the chassis plate 11. The front face of the chassis plate 11 is provided with surfaces—see FIG. 6—onto which the free ends of the fingers 81 of the diaphragm spring 77 engage. During assembly, a flat washer 89 (see FIG. 3) is fitted on the side of the diaphragm spring 77 closest to the drive wheel 9. A cir-clip 91 then locates in a cir-clip groove 93 in the sleeve body 47 of the drive coupler and cam activating member 43. The diaphragm spring 77 therefore urges the face of the conical head 51 against the conical surface 83 to result in a slipping frictional rotational engagement therebetween. This frictional engagement provides a resistance to unwanted rotation of the drive coupler and cam activating member 43 when the motor 3 drives the gearbox 5. This, in turn, inhibits any small degree of rotation of the manually rotatable drive wheel 9 that might otherwise occur without the friction forces.

Once the cir-clip 95 is located within the cir clip groove 93, a further flat washer 97 can be fitted over the sleeve body 47 and then the manually rotatable drive wheel 9 fitted over that sleeve body 47. A further flat washer 99 can then be fitted over the sleeve body 47 and a cir-clip 101 inserted into the cir-clip groove 103. The cam plate 55 can then be fastened relative to the drive wheel 9, and then a cover plate 105 can be provided within the hollow central body part 69 of the drive wheel 9 to cover the components in that hollow body part 69. An end cover plate 107 can be fastened to the rear of the chassis plate 11 to hold the drive coupler 23, and the drive coupler and cam activating member 43 retained. Suitable fastening means 109 can be used to hold the cover plate fixed to the chassis plate 11.

Figure 6:
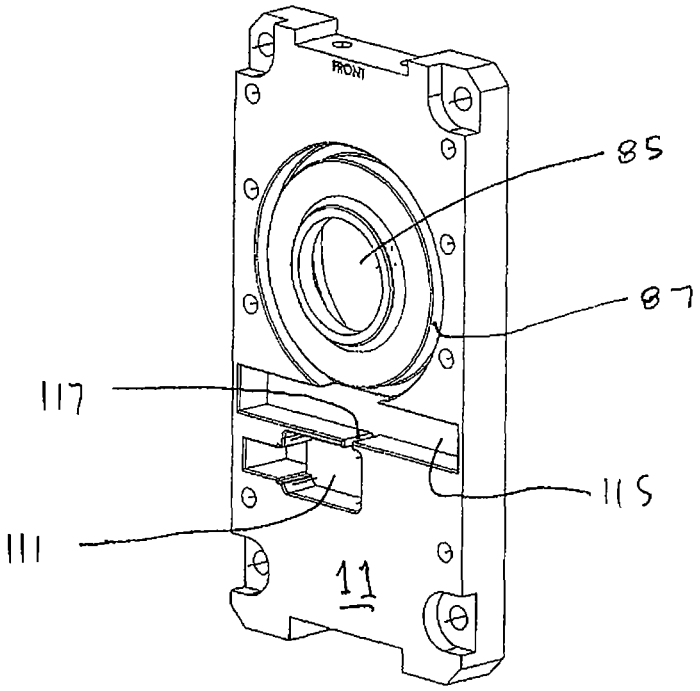
FIG. 6 is an isometric view from one side of a chassis plate that supports the manually rotatable drive wheel.
Figure 7:
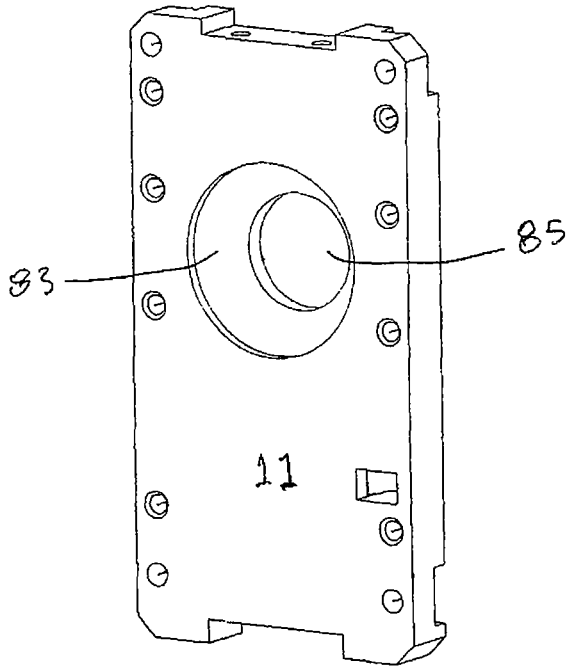
FIG. 7 is an isometric view of the chassis plate from an opposite side shown in FIG. 6.
Figure 16:
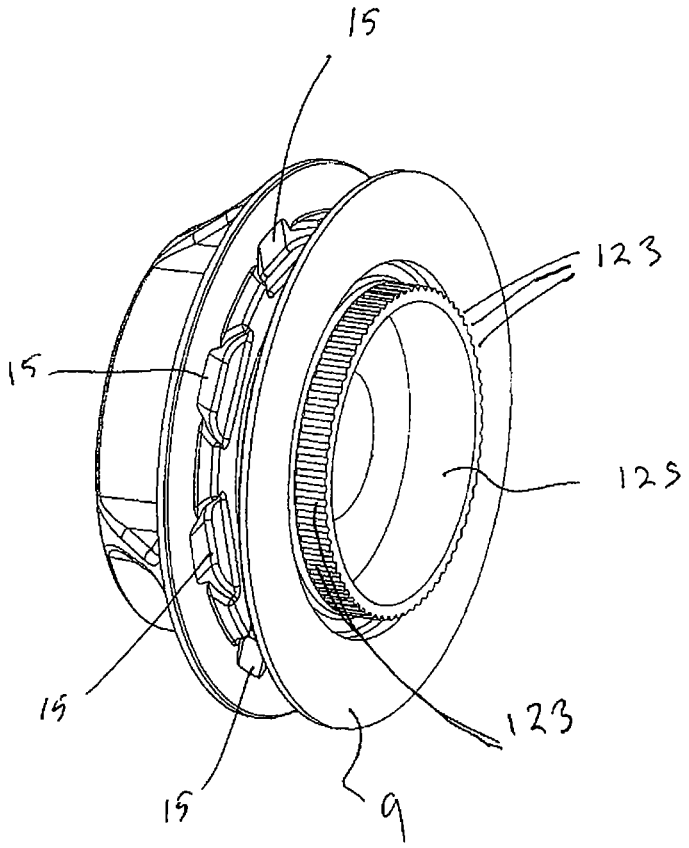
FIG. 16 is a view similar to that of FIG. 15 but taken from the opposite end.
Figure 17:
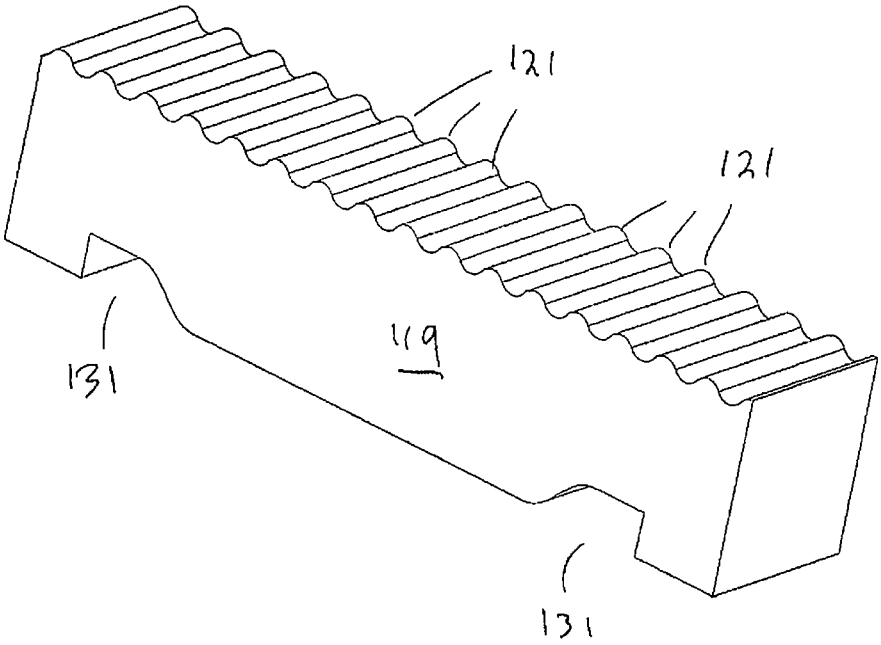
FIG. 17 is a close up isometric view of a slide mechanism that can be driven by the manually rotatable drive wheel.
Figure 18:
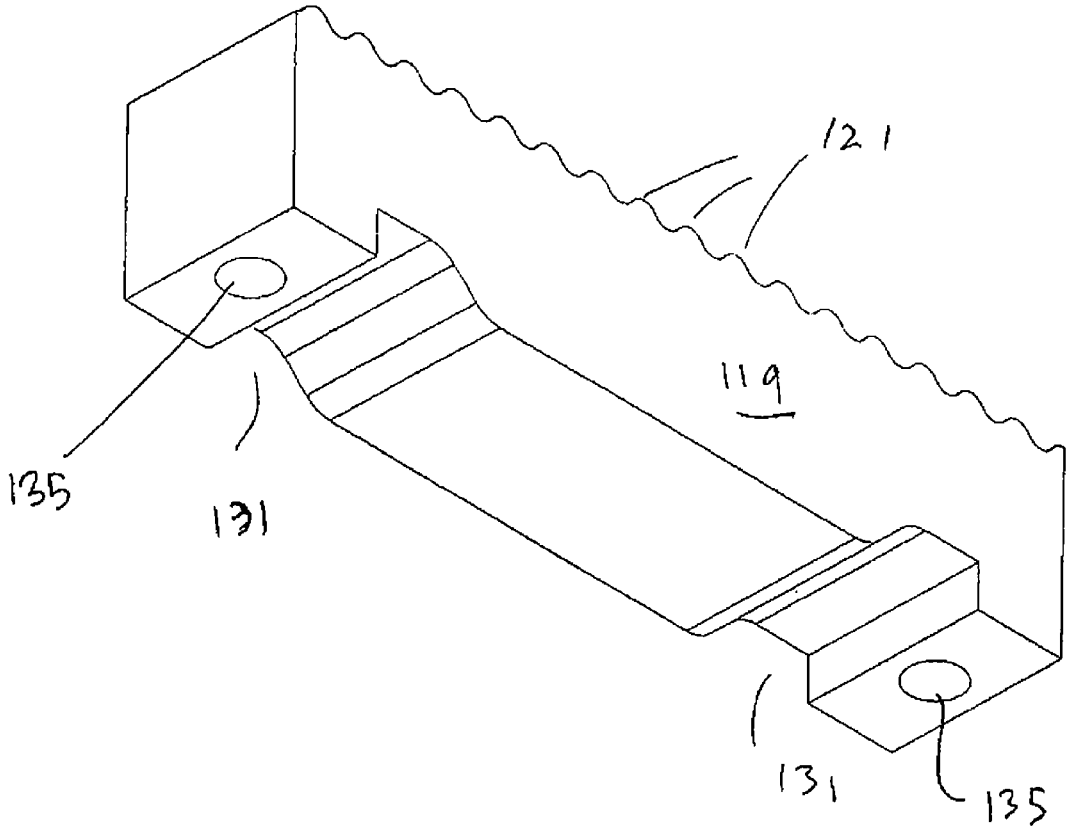
FIG. 18 is an underneath perspective view of the slide shown in FIG. 17.

FIG. 6 shows that the chassis plate 11 has a cavity 111 into which a micro switch 113 (see FIG. 3) can be received. A transversely extending slot 115 is provided immediately above the cavity 111 and the slot intersects with a recess 87. A passageway 117 extends between the cavity 111 and the slot 115—see FIG. 6. The passageway 117 enables an operating head (not clearly shown) of the micro switch 113 to pass into the slot 115. A reciprocating slide 119 (see FIGS. 17 and 18) is provided to reciprocate left to right along the length of the slot 115. Here, the upper surface of the slide 119 is provided with teeth 121. The teeth 121 are arranged to mate with teeth 123 formed on the outer circumferential surface of a lip 125 on an inside end face of the drive wheel 9. This is best shown in FIG. 16. The lip 125 is received within the annular recess 87 in the chassis plate 11. Thus, when the drive wheel 9 is rotated, the teeth 123 engage with the teeth 121 and move the reciprocating slide 119 towards one end or the other of the slot 115. The reciprocating slide 119 therefore traverses left to right, or right to left within the slot 115 until it reaches a respective end of the slot. The under-surface of the reciprocating slide 119 has two notches 131 therein. The notches are arranged to align over the passageway 117 when the reciprocating slide 119 traverses to the respective ends of the slot 115. In this condition, the operating head of the micro switch 113 can move into one of the notches. This, in turn, operates the micro switch 113 to cause the micro switch 113 inhibit against power being supplied to the motor 3 whilst manual drive is being effected from the drive wheel 9 to the shaft 25. The arrangement of the reciprocating slide 119 and the notches 131 provide for this operation for both clockwise or anticlockwise rotation of the drive wheel 9. This arrangement provides a safety feature to inhibit against damage that may occur if power were to be restored during a manual operation of the drive wheel 9.

FIG. 3 shows two spring loaded detent pins 133. These are known detent pins and have therefore not shown in detail. These pins 133 locate within detent recesses 135 in the under surface of the reciprocating slide 119. In use, the detent pins 133 engage with the wall surfaces of the slot 115 to provide an upwardly directed bias force to the reciprocating slide 119, providing a bias mating arrangement between teeth 121 on the reciprocating slide 119 and the teeth 123 carried by the drive wheel 9. Thus, when the reciprocating slide 119 reaches an end travel position within the slot 115, continued rotation of the drive wheel 9 will force the teeth 121 and 123 apart against the bias to allow continued manual rotation of the drive wheel 9 whilst maintaining the slide 119 engaged with the end surfaces of the slot 115.

Figure 10:
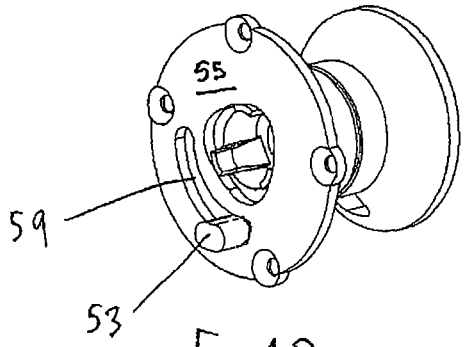
FIG. 10 is an isometric view of the components shown in FIG. 9 in the drive engaged condition, where there has been rotation of the manually rotatable drive wheel in a clockwise direction.
Figure 11:
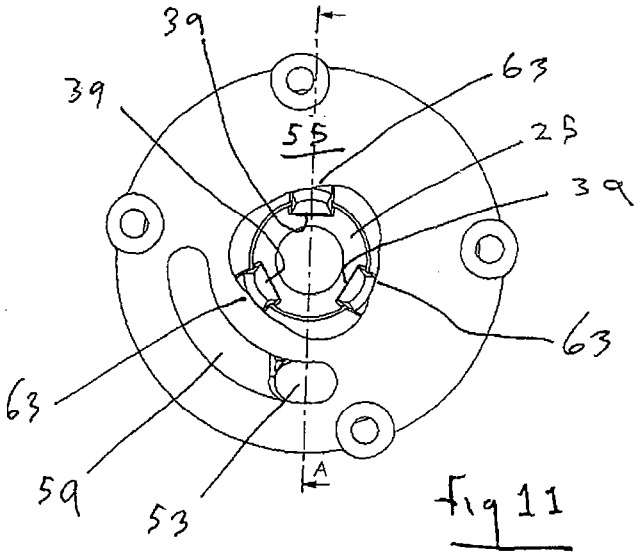
FIG. 11 is an end view of the components shown in FIG. 10.

FIGS. 10 and 11 show the relative rotation of the cam plate 55 relative to the tongue 53 for a clockwise direction of rotation of the drive wheel 9. An anticlockwise direction of rotation of the drive wheel 9 causes the tongue 53 to locate at the opposite end of the arcuate slot 59. FIG. 11 shows that the lobes 63 have engaged with the cam contact surfaces 39 of the drive coupler 23 causing them to be displaced radially inwardly to effect the drive coupling with the shaft 25.

Figure 12:
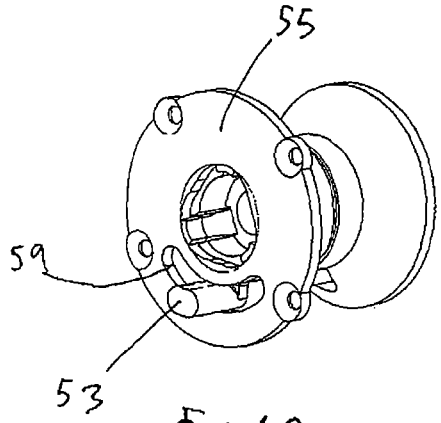
FIG. 12 is a view similar to that of FIG. 10 showing the position of the components when no rotation has been effected to the manually rotatable drive wheel and so there will be freewheeling of the manually rotatable drive wheel.
Figure 13:
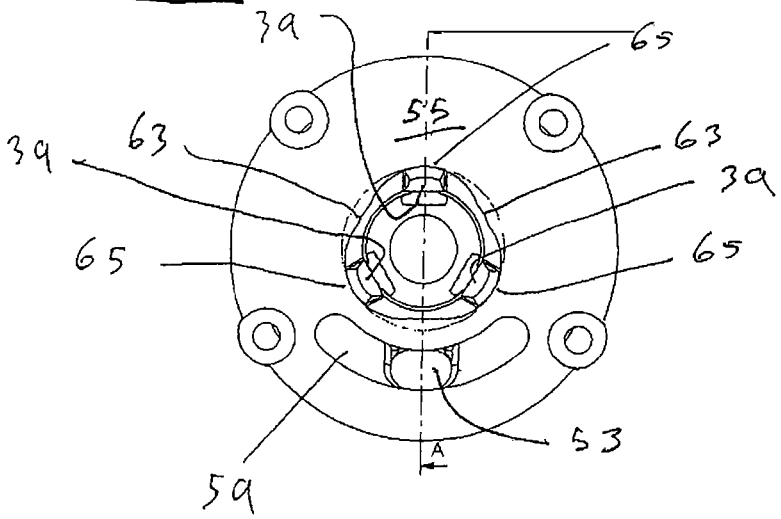
FIG. 13 is an end view, similar to FIG. 11, showing the arrangement of the components in the non-rotated position of the manually rotatable drive wheel.
Figure 14:
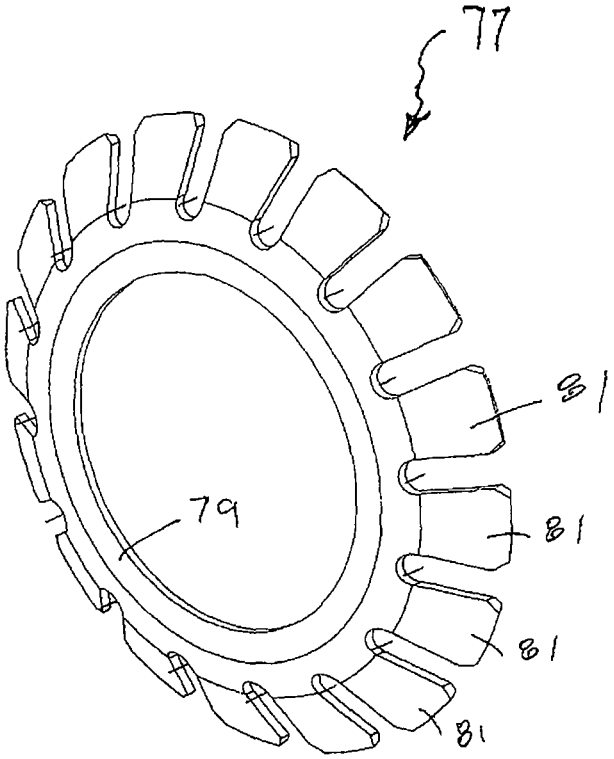
FIG. 14 is an isometric view of a diaphragm spring used for bias loading components to apply a bias force therebetween.
Figure 15:
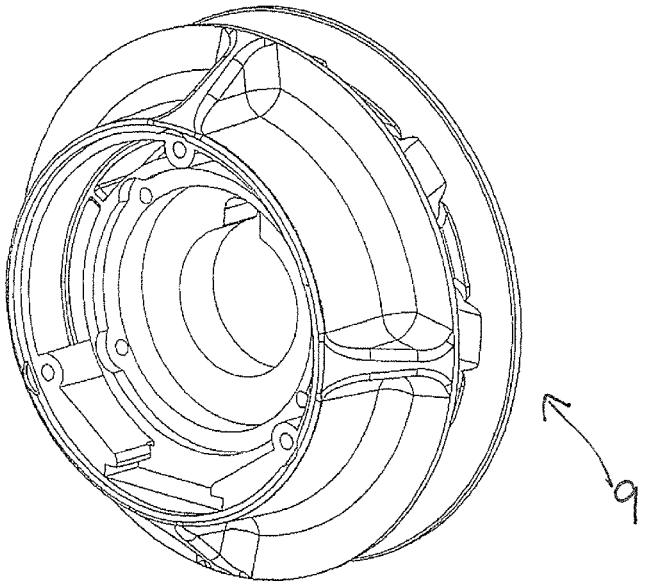
FIG. 15 is a close-up isometric view of the manually rotatable drive wheel from one end.

FIGS. 12 and 13 show the arrangement where the tongue 53 has been centralised within the arcuate slot 59 and where the cam contact surfaces 39 have been radially outwardly deflected into the relief 65 in the cam plate 55. This, in turn, allows freewheeling of the drive wheel 9 when the motor 3 drives the gearbox 5 and rotates the shaft 25.

It should be appreciated that modifications may be made to the embodiment as would be apparent to persons skilled in the arts of drive transmission mechanisms without departing from the ambit of the invention. In one variation, the drive coupler 23 may move radially outwardly to effect the drive engagement between the drive wheel 9 and the shaft 25.

The arrangement disclosed provides for a compact clutch arrangement between the drive wheel 9 and the gearbox 5 that can be initiated by manual drive rotation of the drive wheel 9 either in a clockwise or anticlockwise direction.

Embodiments of the invention have been described in detail in relation to a door operator for a garage door. However, it should be appreciated that embodiments of the invention could equally be used for other types of doors or barriers.

It is to be understood that, if any prior art publication is referred to herein, such reference does not constitute an admission that the publication forms a part of the common general knowledge in the art, in Australia or any other country.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Other modifications may be made without departing from the ambit of the invention the nature of which is to be determined from the foregoing description.

The invention claimed is:

1. An electric motor driven barrier operator with a manually operable drive for use in the event of a power failure, the operator comprising a gear box, the gear box being drive connectable with an electric motor of the operator, the gear box comprising an output for drive coupling with a barrier to effect opening and closing of the barrier by the motor, the gear box also comprising a shaft that rotates when the motor rotates, and the manually operable drive being useable in the event of power failure to effect manual drive rotation movement of the shaft to open and close the barrier via the gear box, the manually operable drive comprising a free wheeling manually rotatable drive wheel carried on the shaft and a clutch mechanism comprising a clutch activation member, a drive coupler keeper and at least one drive coupler, the clutch activation member being mounted for fixed rotation with the manually rotatable drive wheel, and including a stop, the drive coupler keeper being rotationally mounted on the shaft and having an extending tongue configured to engage with the stop of the clutch activation member to limit relative rotation between the clutch activation member and the drive coupler keeper to an engaged position where the tongue engages with the stop as the manually rotatable drive wheel is initially rotated, and where holding the manually rotatable drive wheel stationary in the engaged position or continued rotation of the manually rotatable drive wheel in the engaged position the engaged position to be maintained for fixed rotation of the drive coupler keeper with the manually rotatable drive wheel, the drive coupler keeper supporting the at least one drive coupler for fixed rotation with the drive coupler keeper and allowing movement of the at least one drive coupler in a radially extending direction relative to a central longitudinal axis of the shaft between a first position allowing rotation of the drive coupler and drive coupler keeper about the shaft, and a second position where the drive coupler engages with the shaft for fixed rotation therewith, the drive coupler being acted on by the clutch activation member to effect movement between the first position and the second position as the clutch activation member rotated relative to the drive coupler keeper to the engaged position due to manual rotation of the manually rotatable drive wheel to effect a drive coupling between the manually rotatable drive wheel and the shaft so continued rotation of the manually rotatable drive wheel will drive the shaft to permit manual opening and closing of the barrier via the gear box.

2. An electric motor driven barrier operator as claimed in claim 1, wherein the at least one drive coupler is biased by biasing means to assume the first position displaced in a radially extending direction relative to the central longitudinal axis of the shaft.

3. An electric motor driven barrier operator as claimed in claim 2, wherein the biasing means will displace the at least one drive coupler in a direction radially outwardly away from the central longitudinal axis of the shaft.

4. An electric motor driven barrier operator as claimed in claim 1, wherein the clutch activation member a cam operator carried on the manually rotatable drive wheel, the cam operator having a drive coupler contacting surface shaped to convert rotational movement of the clutch activation member about the shaft to linear movement of the at least one drive coupler in the radially extending direction to effect the drive coupling when the manually operable drive wheel is initially manually rotated to the engaged position, and maintain the drive coupling during continued rotation to impart drive to the drive shaft.

5. An electric motor driven barrier operator as claimed in claim 4, comprising biasing means to rotate the manually rotatable drive wheel and the cam operator away from the engaged position once manual drive to said manually operable drive wheel is ceased, to allow the at least one drive coupler to move to the first position to no longer input drive from the manually rotatable drive wheel to the shaft and allow the manual drive wheel to free wheel.

6. An electric motor driven barrier operator as claimed in claim 1 wherein the barrier is a door.

7. An electric motor driven barrier operator with a manually operable drive for use in the event of a power failure, the operator comprising a gear box, the gear box being drive connectable with an electric motor of the operator, the gear box comprising an output for drive coupling with a barrier to effect opening and closing of the barrier by the motor, the gear box also comprising a shaft that rotates when the motor rotates, and the manually operable drive being useable in the event of power failure to effect manual drive rotation movement of the shaft to open and close the barrier via the gear box, the manually operable drive comprising a free wheeling manually rotatable drive wheel carried on the shaft and a clutch mechanism comprising a cam plate, a cam activating member and at least one drive coupler, the cam plate being mounted for fixed rotation with the manually rotatable drive wheel, and including an arcuate slot, the cam activating member being rotationally mounted on the shaft and having an extending tongue configured to engage with the arcuate slot of the cam plate to limit relative rotation between the cam plate and the cam activating member to an engaged position where the tongue engages with an end of the arcuate slot as the manually rotatable drive wheel is initially rotated, and where holding the manually rotatable drive wheel stationary in the engaged position or continued rotation of the manually rotatable drive wheel in the engaged position the engaged position to be maintained for fixed rotation of the cam activating member with the manually rotatable drive wheel, the cam activating member supporting the at least one drive coupler for fixed rotation with the cam activating member and allowing movement of the at least one drive coupler in a radially extending direction relative to a central longitudinal axis of the shaft between a first position allowing rotation of the drive coupler and cam activating member about the shaft, and a second position where the drive coupler engages with the shaft for fixed rotation therewith, the drive coupler being acted on by the cam plate to effect movement between the first position and the second position as the cam plate rotates relative to the cam activating member to the engaged position due to manual rotation of the manually rotatable drive wheel to effect a drive coupling between the manually rotatable drive wheel and the shaft so that continued rotation of the manually rotatable drive wheel will drive the shaft to permit manual opening and closing of the barrier via the gear box.

8. An electric motor driven barrier operator as claimed in claim 7 wherein the barrier is a door.

* * * * *